US005275007A

United States Patent [19]

Neeser

[11] Patent Number: 5,275,007

[45] Date of Patent: Jan. 4, 1994

[54] CRYOGENIC DEWAR LEVEL SENSOR AND FLUSHING SYSTEM

[75] Inventor: Timothy A. Neeser, Savage, Minn.

[73] Assignee: Minnesota Valley Engineering, Inc., New Prague, Minn.

[21] Appl. No.: 914,962

[22] Filed: Jul. 14, 1992

[51] Int. Cl.[5] ..... F17C 13/02

[52] U.S. Cl. ..... 62/49.2; 62/491; 62/50.7; 62/51.1

[58] Field of Search ..... 62/49.1, 49.2, 51.1, 62/50.7

[56] References Cited

U.S. PATENT DOCUMENTS

| | | | |
|---|---|---|---|
| 3,442,091 | 5/1969 | Klipping et al. | 62/49.2 |
| 3,938,347 | 2/1976 | Riedel et al. | 62/49.2 |
| 4,135,548 | 1/1979 | Sears | 62/49.2 X |
| 4,489,569 | 12/1984 | Sitte | 62/49.2 |
| 4,506,512 | 3/1985 | Delacour et al. | 62/49.2 |
| 5,018,358 | 5/1991 | Lee et al. | 62/49.2 X |
| 5,070,935 | 12/1991 | Sitte et al. | 62/49.2 X |

FOREIGN PATENT DOCUMENTS

| | | | |
|---|---|---|---|
| 0278389 | 9/1914 | Fed. Rep. of Germany | 62/49.2 |
| 0039898 | 3/1983 | Japan | 62/49.2 |
| 0184395 | 10/1983 | Japan | 62/49.2 |
| 0203295 | 11/1983 | Japan | 62/49.2 |
| 2021099 | 1/1990 | Japan | 62/49.2 |
| 8801895 | 2/1990 | Netherlands | 62/49.2 |

*Primary Examiner*—Henry A. Bennet
*Assistant Examiner*—Christopher Kilner
*Attorney, Agent, or Firm*—Rockey, Rikfin and Ryther

[57] ABSTRACT

The sensor assembly includes a sensor tube in communication with the inner tank. A flush line extending from the liquid cryogen fill line is connected to the sensor tube at a three-way valve. The three way valve also connects the sensor tube to a pressure transducer. During normal operation, the sensor tube is in communication with the pressure transducer such that the level of liquid in the dewar can be monitored. When the liquid level falls below a predetermined level, the pressure transducer activates the three-way valve to connect the sensor tube to the flush line and opens a solenoid located in the fill line. As the cryogen liquid enters the fill line, a portion of it is diverted through the flush line, is vaporized and is passed through the sensor tube. The relatively warm gas flow in the sensor tube prevents the formation of ice and eliminates the problems associated therewith. A timer reverses the three-way valve to reconnect the sensor tube to the pressure transducer so that the pressure transducer can close the second solenoid and terminate the fill operation when the predetermined maximum liquid level has been reached.

17 Claims, 1 Drawing Sheet

FIGURE
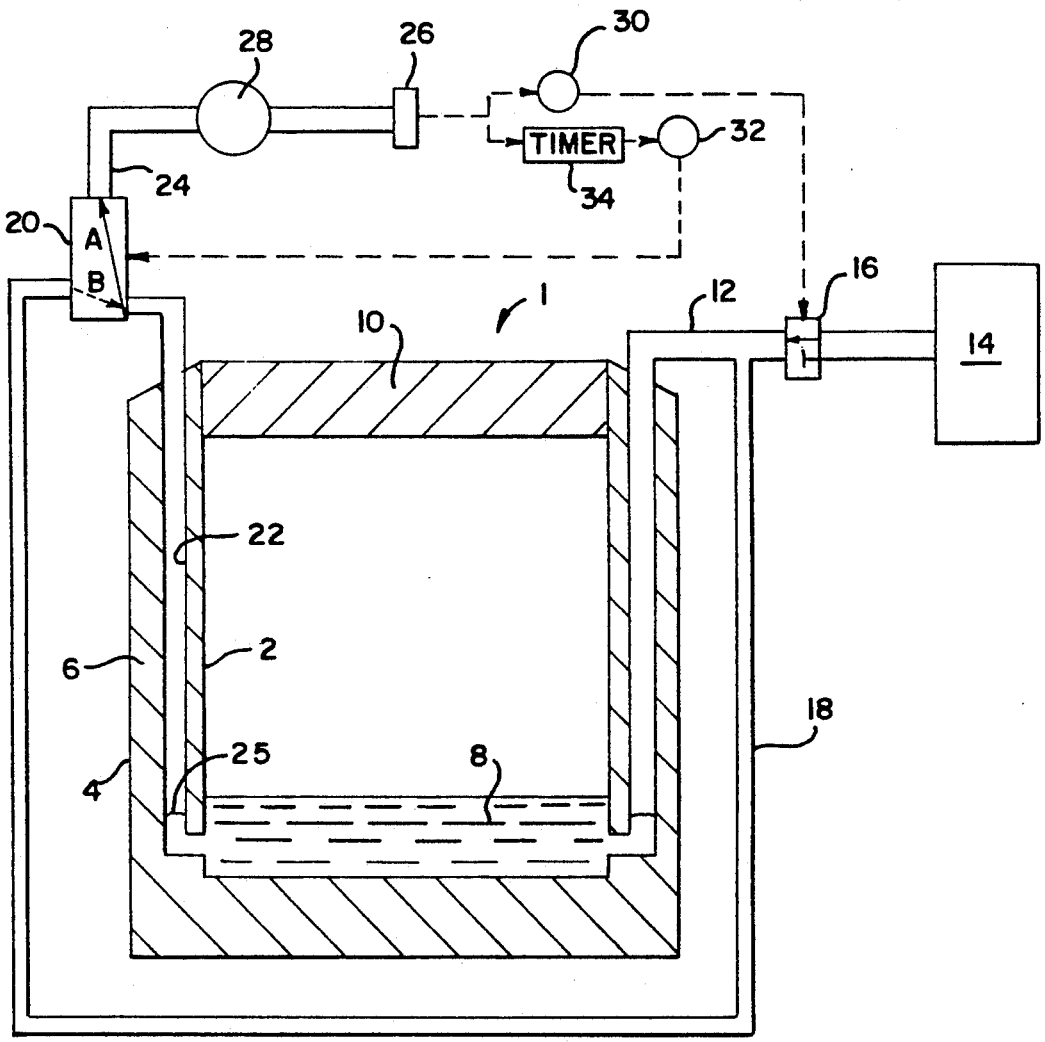

CRYOGENIC DEWAR LEVEL SENSOR AND FLUSHING SYSTEM

BACKGROUND OF THE INVENTION

The invention relates, generally, to cryogen storage dewars and, more particularly, to a level sensor and flush system for such devices.

Cryobiological storage dewars are used to store heat sensitive products such as biological specimens at temperatures between −90° C. and −196° C. A typical dewar includes an inner tank for retaining the cryogenic fluid, such as liquid nitrogen, and biological specimens and an outer wall surrounding and spaced from the inner tank. The space between the tank and the outer wall is packed with insulating material and a vacuum is created therein A removable foam insulated cover provides access to the interior of the dewar.

To maintain the desired low temperature, a specific level of cryogenic liquid must be maintained in the dewar. Over time, however, heat transfer between the external environment and the interior of the dewar will vaporize the liquid thereby lowering the level of cryogenic liquid in the dewar. If the drop in the level of the cryogen was not corrected, the temperature in the dewar would rise to an undesirable level.

Accordingly, automatic cryogenic liquid refill systems have been developed. One such system includes a vertically extending tube in fluid flow communication with the inner tank of the dewar Cryogen will fill the tube to the same level as the cryogen in the inner tank. Thermostats for sensing the presence or absence of the cryogenic liquid are suspended in the tube on a flexible member Typically, four thermistors are used—a low sensor, a high sensor and two alarm sensors The low sensor generates a signal when the liquid cryogen reaches a predetermined minimum level to open a valve to deliver more cryogen to the dewar. The high sensor delivers a signal to shut the valve and terminate delivery of liquid cryogen when the liquid reaches a predetermined maximum level. The other two sensors are used as alarms to generate a signal should either of the high or low sensors fail. The flexible member on which the thermistors are suspended can be raised or lowered in the tube to adjust the level of liquid cryogen.

One problem with this design is that it is difficult to accurately manually adjust the location of the sensors to change the cryogenic liquid level. Another problem with such a system is that because there is no fluid flow in the tube, the extremely cold cryogen will cause ice to build up in the tube thereby preventing the operation of the thermistors. Moreover, the ice can either prevent movement of the sensors or can damage the sensors when they are moved.

In an effort to solve some of these problems, a system using a pressure transducer located at the end of the tube has been developed. A column of compressed cryogen vapor transmits changes in the level of the cryogen fluid in the dewar to the pressure transducer A solenoid valve is opened and closed in response to signals from the pressure transducer to control delivery of cryogen liquid to the dewar.

While the pressure transducer allows more accurate measurement of changes in the cryogen level, it does not provide fluid flow in the tube so that the icing problems discussed above are still present. When icing occurs in the tube, the pressure transducer's responsiveness is affected resulting in undesirable fluctuations in the liquid level in the dewar.

Thus, an improved level sensor assembly for a cryogenic dewar is desired

SUMMARY OF THE INVENTION

The sensor assembly of the invention overcomes the above-noted shortcomings in the prior art and includes a sensor tube in communication with the inner tank of the dewar similar to that of the prior art. A flushing line extending from the liquid cryogen fill line is connected to the sensor tube by a three-way valve. The three-way valve also connects the sensor tube to a pressure transducer. During normal operation, the sensor tube is in communication with the pressure transducer such that the level of liquid in the dewar can be monitored When the liquid level falls below a predetermined level, the pressure transducer produces a signal that activates the three-way valve to connect the sensor tube to the flush line and opens a solenoid located in the fill line. As the cryogenic liquid enters the fill line, a portion of it is diverted through the flush line, is vaporized and is passed through the sensor tube. The relatively warm gas flow in the sensor tube prevents the formation of ice and eliminates the problems associated therewith. A timer reverses the three-way valve to reconnect the sensor tube to the pressure transducer so that the pressure transducer can close the second solenoid and terminate the fill operation when the predetermined maximum liquid level has been reached.

BRIEF DESCRIPTION OF THE DRAWING

The figure is a schematic view of the level sensor and flushing system of the invention.

DETAILED DESCRIPTION OF THE INVENTION

Referring more particularly to the figure, the invention consists of a dewar 1 having an inner tank 2 surrounded by outer wall 4. A vacuum insulated space 6 is created between the inner tank 2 and outer wall 4 to minimize heat transfer from the external environment to the cryogenic fluid 8. Although any cryogen can be used as fluid 8, liquid nitrogen is most commonly used. A removable insulated cover 10 closes the top of dewar 1 to allow access to the interior thereof.

A liquid cryogen fill line 12 connects the inner tank 2 with a source of liquid cryogen 14 such as a large volume vacuum insulated storage tank. Typically, the liquid cryogen is at approximately 22 psi although the pressure can vary as dictated by the needs of the system.

An automatically operated solenoid valve 16 is located in line 12. When valve 16 is open as shown, liquid cryogen will flow from source 14 to dewar 1 via line 12. When valve 16 is closed flow of cryogen will be terminated. Because the length of line 12 between solenoid valve 16 and liquid cryogen source 14 is uninsulated, the cryogen held in this line will vaporize. Thus, when valve 16 is opened, vapor will initially flow through line 12 until the liquid cryogen from tank 14 begins to flow through the line.

An uninsulated flush line 18 is connected to fill line 12 downstream of valve 16 and terminates at three-way valve 20. The uninsulated flush line 18 can consist of copper tubing, for example. Also connected at valve 20 is the sensor tube 22 and a line 24 communicating with the pressure transducer 26. Valve 20 is movable between a first position where sensor tube 22 is connected to line 24 (position A) and a second position where sensor tube 22 is connected to flush line 18 (position B).

The sensor tube 22 extends from the bottom of inner tank 2 to the top of dewar 1. While tube 22 is located in insulated space 6, it is spaced from the inner wall 2. As a result, heat transfer to the sensor tube 22 from outer wall 4 will vaporize the cryogen in the tube such that a column of compressed cryogen vapor will extend between the liquid/vapor interface 25 and the valve 20. The compressed cryogen vapor pressure in tube 22 will increase or decrease with the cryogen liquid level 8 in dewar 1.

Line 24 includes a damper 28 intermediate of the pressure transducer 26 and valve 20. Damper 28 is a relatively large volume chamber that protects the pressure transducer 26 from pressure surges. When valve 20 is switched between positions A and B, high pressure gas can bleed from the flush line and sensor tube. This high pressure gas could damage the relatively sensitive pressure transducer if the gas was not allowed to expand in damper 28. By expanding the gas in damper 28, the pressure of the gas is lowered to a level that can be accommodated by pressure transducer 26.

The electronics for controlling the operation of valves 16 and 20 consists of a first relay 30 for opening and closing solenoid 16. Relay 30 is operated directly upon a signal from pressure transducer 26. A second relay 32 moves valve 20 between its first and second positions. Relay 32 is operated by a conventional timing circuit 34 such that the opening and closing of valve 20 is time dependent. Alternately, a microprocessor can be employed as described hereafter. Timing circuit 34 is initiated upon receipt of a signal from pressure transducer 26.

The operation of the system will now be described. Assume that dewar 1 is filled with liquid cryogen at the desired level. Valve 16 will be closed and valve 20 will be set to position A such that the gas column in sensor tube 22 is in communication with line 24 and the pressure transducer 26. Transducer 26 will constantly monitor the pressure in tube 22. This pressure reflects the pressure head of the liquid cryogen in dewar 1. As the liquid cryogen vaporizes, the level of liquid will drop and the pressure head will decrease. This decrease will be reflected by a corresponding pressure drop at transducer 26.

When the pressure falls below a predetermined value, pressure transducer 26 will operate relay 30 and initiate timer circuit 34. Relay 30 will open valve 16 and simultaneously timer circuit 34 will operate relay 32 to move valve 20 to position B. With the valves so positioned cryogen fluid will be delivered from source 14. The cryogen will initially be delivered as a gas as previously described and then will be delivered as a liquid. A portion of the cryogen fluid delivered via line 14 will be diverted through uninsulated flush line 18. Because line 18 is uninsulated, the cryogen will be vaporized and will expand as heat is transferred thereto. The expanding gas will be forced through the sensor tube 22 to melt and flush ice therefrom.

The process will continue until timer circuit 34 again operates relay 32. Relay 32 will then move valve 20 back to position A where sensor tube 22 is in communication with pressure transducer 26. The flush cycle for the typical dewar fill operation will be on the order of 30 seconds where the entire fill operation takes 30 minutes.

Once valve 20 is moved to position A the flush operation is terminated but the liquid cryogen continues to be delivered to dewar 1 via line 12. The pressure transducer 26 is able to monitor the filling operation such that when the pressure in pressure tube 22 reaches a value corresponding to the desired liquid level, pressure transducer 26 will signal relay 30 which will close valve 14 to terminate the filling operation. Valve 14 will remain closed and valve 20 will remain in position A until pressure transducer 26 again detects a pressure drop and reactivates the flush and filling cycle.

A microprocessor can be employed to control the pressure values at which pressure transducer 26 initiates relay 30 and to provide the timing function for relay 32 if desired. Thus, the upper and lower fill levels can be easily adjusted and the length of the flush cycle can be varied as desired. The use of the flush cycle prevents ice build up in sensor tube 22 and ensures proper operation of pressure sensor 26.

While the invention has been described in some detail with respect to the figure, it is to be understood that numerous changes in the construction and operation of the device can be made without departing from the spirit and scope of the invention.

What is claimed:

1. A level sensor and flushing system for a cryogenic vessel comprising:
   (a) a vessel for retaining a quantity of cryogenic liquid;
   (b) means for sensing the level of cryogenic liquid in said vessel including a sensor tube in fluid communication with said vessel and a pressure sensor exposed to the fluid in said sensor tube;
   (c) means for delivering cryogenic fluid to said vessel upon receipt of a signal from said means for sensing indicating that the level of liquid has dropped below a predetermined value; and
   (d) means for diverting cryogenic fluid through said sensor tube while filling said vessel to defrost and remove ice from the sensor tube.

2. The system of claim 1, wherein said vessel consists of a thermally insulated tank.

3. The system of claim 1, wherein the means for delivering includes a supply line connecting said vessel to a supply of cryogenic liquid and an automatically operated valve in said supply line to selectively allow cryogenic fluid to flow from said supply to said means for retaining.

4. The system of claim 1, wherein the means for diverting includes a flush line connected between said means for delivering and said sensor tube whereby a portion of the cryogen delivered through said means for delivering will be diverted into the flush line and through the sensor tube.

5. The system of claim 1, wherein said sensor tube and said means for diverting are connected by a valve means.

6. The system of claim 5, wherein said valve means is open and closed upon receipt of a signal from said means for sensing.

7. The system of claim 5, wherein said valve means is operated by a timing circuit, said timing circuit being initiated by a signal from said means for sensing.

8. The system of claim 5, wherein said means for sensing further includes a pressure transducer in communication with a line, said line being connected to said sensor tube by said valve means.

9. A level sensor and flushing system for a cryogenic vessel, comprising:

(a) means for retaining a quantity of cryogenic liquid;

(b) a tube in fluid flow communication with said means for retaining for receiving a portion of the cryogenic liquid;

(c) a fill line connecting a supply of cryogenic liquid to said means for retaining, an automatically operated valve located in said fill line to selectively open and close said fill line;

(d) a three-way valve, operable between first and second positions;

(e) an uninsulated flush line connected to said fill line and connected to said tube via said three-way valve when said three-way valve is in said first position;

(f) a pressure transducer connected to said tube via said three-way valve when said three-way valve is in said second position, said pressure transducer generating a signal corresponding to the level of cryogenic liquid in said means for retaining; and (g) means for opening and closing said valve and for moving said three-way valve between its first and second positions in response to the signal from the pressure transducer.

10. The system of claim 9, wherein said means for retaining consists of a thermally insulated tank.

11. The system according to claim 10, wherein said three-way valve is moved between its first and second positions by a timing circuit.

12. A level sensor and flushing system for a cryogenic dewar, comprising:

(a) a dewar for retaining a quantity of cryogenic liquid;

(b) a fill line connecting said dewar to a supply of cryogenic liquid including a valve for allowing cryogenic liquid to flow from the supply to the dewar;

(c) a sensor tube in fluid flow communication with the cryogenic liquid in the dewar;

(d) a flush line connected to the fill line for diverting some of the cryogenic liquid from the fill line, said flush line including means for vaporizing cryogenic liquid therein;

(e) a pressure sensor; and (f) means for connecting the sensor tube to either the pressure sensor or the flush line.

13. The system according to claim 12, wherein said means for connecting includes a three-way valve.

14. The system according to claim 13, wherein said three-way valve is controlled by a timing circuit, said timing circuit being initiated by signal from said pressure transducer.

15. The system according to claim 12, wherein said means for vaporizing consisting of an uninsulated line.

16. A level sensor and flushing system for a cryogenic vessel comprising:

(a) a vessel for retaining a quantity of cryogenic liquid;

(b) means for sensing the level of cryogenic liquid in said vessel including a sensor tube in fluid communication with said vessel;

(c) means for delivering cryogenic fluid to said vessel upon receipt of a signal from said means for sensing indicating that the level of liquid has dropped below a predetermined value;

(d) means for diverting cryogenic fluid through said sensor tube while filling said vessel to defrost and remove ice from the sensor tube; and (e) value means connecting said sensor tube and said means for diverting, said valve means being operated by a timing circuit, said timing circuit being initiated by a signal from said means for sensing.

17. A level sensor and flushing system for a cryogenic vessel comprising:

(a) a vessel for retaining a quantity of cryogenic liquid;

(b) means for sensing the level of cryogenic liquid in said vessel including a sensor tube in fluid communication with said vessel and a pressure transducer in communication with a line;

(c) means for delivering cryogenic fluid to said vessel upon receipt of a signal from said means for sensing indicating that the level of liquid has dropped below a predetermined value;

(d) means for diverting cryogenic fluid through said sensor tube while filling said vessel to defrost and remove ice from the sensor tube; and (e) valve means connecting said line to said sensor tube and connecting said sensor tube to said means for diverting.

* * * * *